US006823590B2

(12) United States Patent
Uchiyama et al.

(10) Patent No.: US 6,823,590 B2
(45) Date of Patent: Nov. 30, 2004

(54) ELECTRIC ROTARY SHAVER

(75) Inventors: Hiromi Uchiyama, Matsumoto (JP); Tsuyoshi Nakano, Matsumoto (JP); Kyoichi Kawafune, Matsumoto (JP); Yukio Izumi, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 09/759,476

(22) Filed: Jan. 12, 2001

(65) Prior Publication Data

US 2002/0062565 A1 May 30, 2002

(30) Foreign Application Priority Data

Nov. 28, 2000 (JP) ..... 2000-361669

(51) Int. Cl.[7] ..... B26B 19/14
(52) U.S. Cl. ..... 30/43.6; 30/346.51
(58) Field of Search ..... 30/346.51, 43.4, 30/43.5, 43.6

(56) References Cited

U.S. PATENT DOCUMENTS

| | | | | | |
|---|---|---|---|---|---|
| 3,116,551 | A | * | 1/1964 | Anton | 30/43.6 |
| 3,233,323 | A | * | 2/1966 | Driessen | 30/43.5 |
| 3,694,915 | A | | 10/1972 | Beusink | |
| 3,715,803 | A | * | 2/1973 | Tyler | 30/34.1 |
| 3,797,109 | A | * | 3/1974 | Yamada et al. | 30/34.1 |
| 3,844,033 | A | * | 10/1974 | Yonkers | 30/346.51 |
| 3,913,225 | A | * | 10/1975 | Tietjens et al. | 30/43.6 |
| 4,001,932 | A | * | 1/1977 | Herrick | 30/43.5 |
| 4,038,748 | A | * | 8/1977 | Tyler | 30/43.6 |
| 4,077,120 | A | * | 3/1978 | Herrick et al. | 30/43.5 |
| 4,168,570 | A | * | 9/1979 | Bakker et al. | 30/43.6 |
| RE30,857 | E | * | 2/1982 | Tyler | 30/43.5 |
| 5,283,953 | A | * | 2/1994 | Ikuta et al. | 30/43.5 |
| 5,394,611 | A | * | 3/1995 | Okabe et al. | 30/41.6 |
| 5,625,950 | A | * | 5/1997 | Sterk et al. | 30/346.51 |
| 5,687,481 | A | | 11/1997 | De Boer et al. | |
| 5,983,501 | A | * | 11/1999 | Izumi | 30/43.4 |
| 6,145,200 | A | * | 11/2000 | Jorna et al. | 30/43.6 |
| 6,151,780 | A | * | 11/2000 | Klein | 30/43.92 |
| 6,199,282 | B1 | * | 3/2001 | Uchiyama et al. | 30/43.6 |
| 6,460,252 | B1 | * | 10/2002 | Nakano | 30/43.4 |
| 6,568,081 | B2 | * | 5/2003 | Barish | 30/43.6 |
| 6,581,289 | B2 | * | 6/2003 | Nakano | 30/43.6 |
| 6,584,691 | B1 | * | 7/2003 | Gerasimov et al. | 30/43.6 |
| 6,647,626 | B2 | * | 11/2003 | Nakano | 30/43.6 |

FOREIGN PATENT DOCUMENTS

| | | |
|---|---|---|
| GB | 1 406 140 | 9/1975 |

* cited by examiner

*Primary Examiner*—Allan N. Shoap
*Assistant Examiner*—Jason Prone
(74) *Attorney, Agent, or Firm*—Koda & Androlia

(57) ABSTRACT

An electric rotary shaver comprising: a cutter frame having a plurality of outer cutter holes, outer cutters disposed in outer cutter holes so as to be tiltable in any direction, and inner cutters rotatably disposed inside the outer cutters and connected to inner cutter drive shafts that are rotationally driven and urged in a direction that causes the inner cutter drive shafts to protrude outward; wherein a cutter retaining plate is provided inside the cutter frame so as to be on a main body side of the electric shaver, and fulcrum plates are tiltably shaft-supported in the cutter retaining plate so as to be positionally correspond to the outer cutter holes; and the outer cutters are shaft-supported in the fulcrum plates via supporting members in a direction that is perpendicular to the direction in which the fulcrum plates are shaft-supported by the cutter retaining plate, thus being tiltable.

8 Claims, 8 Drawing Sheets

ELECTRIC ROTARY SHAVER

BACKGROUND OF THE INVENTION

1. Field of the Invention

The present invention relates to an electric rotary shaver and more particularly to a structure that tiltably supports outer cutters in a cutter frame of an electric rotary shaver.

2. Prior Art

FIG. 9 is a perspective view of the overall structure of a conventional electric rotary shaver. In this electric shaver 10, a cutter head 20 is detachably mounted on the upper portion of a main body case 12. Three outer cutters 22 are mounted in the cutter head 20 so that the centers of the outer cutters are arranged at the vertices of an equilateral triangle. Slits for introducing hair are formed in the radial direction in the outer cutters 22. In each outer cutter 22, an annular outside hair introduction region V and inside hair introduction region W are formed in a concentric configuration, and a groove is formed in the boundary area between the outside hair introduction region V and inside hair introduction region W.

FIG. 10 shows the internal structure of the above electric rotary shaver. The cutter head 20 is constructed from a cutter frame 30, metal outer cutters 22, outer cutter holders 24 that hold the outer cutters 22, metal inner cutters 26, inner cutter bases 28 that support the inner cutters 26, and cutter retaining plates 31 that hold the inner cutters 26 so that the inner cutters 26 are rotated. The cutter frame 30, outer cutter holders 24, inner cutter bases 28 and cutter retaining plates 31 are all made of a synthetic resin. The outer cutters 22 are supported so that they cannot rotate relative to the outer cutter holders 24, thus ensuring the outer cutters 22 not to rotate together with the inner cutters 26.

The reference numeral 32 is a cutter cradle that is installed so as to cover the opening of the main body case 12. Inner cutter drive shafts 34 that transmit the rotational driving force of a motor 50 to the inner cutters 26 protrude from the cutter cradle 32 in the installation positions of the respective inner cutters 26. The inner cutter drive shafts 34 are provided in coaxial with the inner cutter bases 28 and engage with the inner cutter bases 28 in a dovetail engagement so that each of the inner cutter drive shafts 34 can rotate as a unit with the corresponding inner cutter base 28.

The reference numeral 36 refers to springs that constantly urge the inner cutter drive shafts 34 upward. The outer cutters 22 are supported floatingly by these springs 36 via the inner cutters 26, inner cutter bases 28 and inner cutter drive shafts 34.

Engaging projections 38 are disposed on the outer circumferences of the lower ends of the inner cutter drive shafts 34 and engaged with a plurality of shaft engaging portions 42 disposed in upright positions on the inner cutter drive gears 40, and the inner cutter drive gears 40 are engaged with a gear 52 fastened to the output shaft of the motor 50. The inner cutter drive shafts 34 are thus linked to the motor 50. The inner cutter drive shafts 34 are provided so as to tilt in all directions with respect to the axial lines of the inner cutter drive gears 40.

As described above, the outer cutters 22 are supported while being urged by the springs 36 in a direction that causes the outer cutters 22 to protrude to the outside. The outer cutters 22 are thus movable in and out of the outer cutter holders 24, and also the outer cutters 22 are tiltable within a specified angular range in all directions inside the outer cutter holders 24. As shown in FIG. 10, the outer cutters 22 are disposed in the outer cutter holes 44. However, since the internal diameter of the outer cutter holes 44 is slightly larger than the external diameter of the outer cutters 22, the outer cutters 22 can move inward and outward with respect to the outer cutter holders 44 and can tilt within a specified angular range in any desired direction.

As seen from the above, the outer cutters 22 are supported in the cutter frame 30 so that the outer cutters 22 can tilt and move inward and outward. The outer cutters 22 are, therefore, fitted against the skin as a result of the outer cutters 22 protruding outward to an appropriate degree and tilting in the desired direction when the electric shaver is brought into contact with the jaw, cheek, etc., so that hair is cut reliably.

In a conventional electric shaver, the outer cutters 22 can tilt with respect to the cutter frame 30 because the internal diameter of the outer cutter holes 44 is slightly larger than the external diameter of the outer cutters 22 (as described above). The outer cutters 22 are tiltable because of this clearance.

However, in the conventional electric shaver, the clearance between the outer cutter holes 44 and outer cutters 22 is not very large. As a result, even in cases where the outer cutters 22 are allowed to tilt due to this clearance, the outer cutters 22 cannot tilt to a very great extent. If an increased clearance is given between the outer cutters 22 and the outer cutter holes 44 to an excessive extent, the outer cutters 22 are loose in the outer cutter holes 44. As a result, it becomes difficult to determine the center positions of the outer cutters 22, and the rotation of the inner cutters 26 becomes unstable.

FIGS. 11(*a*) and 11(*b*) show the manner of tilting of the outer cutters 22 of a conventional electric shaver. As seen from FIG. 11(*a*), the outer cutter 22 is disposed with a slight gap left between the outer cutter 22 and the outer cutter hole 44, and the outer cutter 22 tilts inside the corresponding outer cutter hole 44 as shown in FIG. 11(*b*). When the outer cutter 22 tilts inside the outer cutter hole 44 in a conventional electric shaver, as seen from FIG. 11(*b*), once the protruding edge 21 at the lower-end edge of the outer cutter 22 contacts the undersurface of the outer cutter hole 44, the outer cutter 22 cannot tilt any further from this state. Thus, the tilting angle of the outer cutters 22 is limited. As seen from the above, in a conventional electric shaver, since the tilting angle of the outer cutters 22 is restricted by the positional relationship between the outer cutters 22 and the outer cutter holes 44, it is difficult to increase the tilting range of the outer cutters 22.

SUMMARY OF THE INVENTION

The present invention solves the above-described problems. The object of the present invention is to provide an electric rotary shaver in which the outer cutters are supported so as to be movable and tiltable with respect to the cutter frame and in which the outer cutters have increased tilting range compared to that of a conventional electric shaver. Thus, in the electric rotary shaver of the present invention, fitting between the skin and the outer cutters is good, and the cutting efficiency is also good.

In order to accomplish the above object, the present invention is structured as described below.

More specifically, in an electric rotary shaver that comprises: a cutter frame provided with a plurality of outer cutter holes, outer cutters disposed in respective outer cutter holes so as to be tiltable in any direction, and inner cutters rotatably disposed inside the outer cutters, the inner cutters being connected to inner cutter drive shafts that are rotationally driven and urged in a direction that causes the inner cutter drive shafts to protrude outward; the rotary shaver is further comprised of: a cutter retaining plate provided inside the cutter frame so as to be on a main body side of the electric shaver, and fulcrum plates respectively shaft-supported in the cutter retaining plate in a tiltable fashion, the fulcrum plates being disposed so as to positionally correspond respectively to the outer cutter holes; and in addition, the outer cutters are shaft-supported in the respective fulcrum plates via supporting members in a direction that is perpendicular to a direction in which the fulcrum plates are shaft-supported by the cutter retaining plate, so that the outer cutters are tiltable.

In the present invention, the supporting directions in which the respective fulcrum plates are shaft-supported are set so as to be disposed on radial lines that passes through the center of the cutter frame, and the supporting directions in which the outer cutters are shaft-supported are set so as to be disposed in directions that are perpendicular to such radial lines.

Also, in the present invention, pairs of supporting pillars that have pivot shafts are formed on the cutter retaining plate at positions that correspond to the respective outer cutter holes, and pairs of engagement pillars that have slot-form engaging holes are formed on the fulcrum plates; and the pivot shafts are engaged with the engaging holes, thus allowing the outer cutters to be moved up and down.

Furthermore, in the present invention, outer cutter fastening rings are shaft-supported in the fulcrum plates, and the outer cutters are tiltably supported in the fulcrum plates by way of the outer cutter fastening rings.

In addition, in the present invention, the outer cutters are provided in outer cutter casings that are set tiltable inside the outer cutter holes, and the outer cutter casings are supported in the outer cutter fastening rings.

Also, in the present invention, the cutter retaining plate is constantly urged with respect to the cutter frame in a direction that causes the outer cutters to protrude outward and is installed so that the cutter retaining plate can be moved up and down.

DETAILED DESCRIPTION OF THE INVENTION

A preferred embodiment of the electric rotary shaver of the present invention will be described below with reference to the accompanying drawings.

The electric rotary shaver of the present invention is characterized in that each of the outer cutters 22 is supported by a pair of pivot shafts disposed perpendicular to each other so that the outer cutters 22 are tiltable inside the outer cutter holes 44 of a cutter frame 30.

Figure 1:
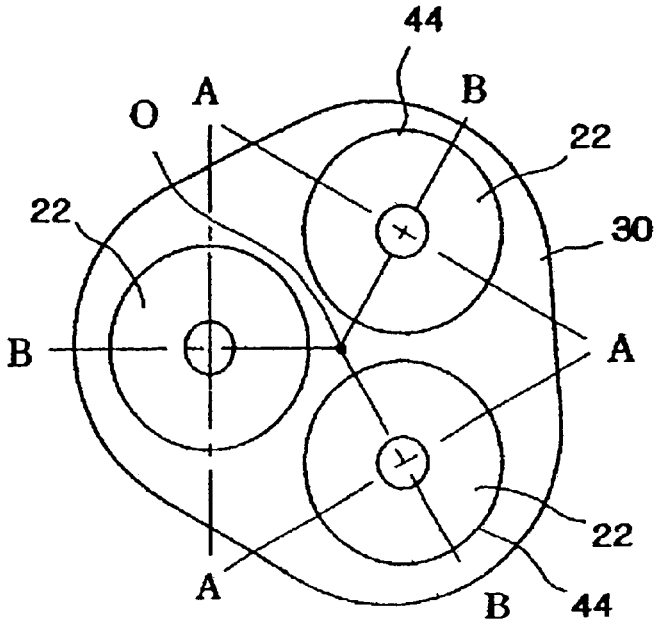
FIG. 1 is an explanatory diagram that illustrates an example in which the outer cutters are supported in the cutter frame via pivot shafts.

FIG. 1 is a schematic diagram that illustrates the manner of supporting the outer cutters 22 in the cutter frame 30 by the pivot shafts. Three outer cutters 22 are provided in the cutter frame 30 so that the center positions of the outer cutters 22 are at the vertices of an equilateral triangle.

The positions A and B are locations where the pivot shafts are disposed. The pivot shafts that tiltably support each of the outer cutters 22 are disposed on imaginary two lines that pass through the center of each outer cutter 22 and are perpendicular to each other. In this embodiment, the pivot shafts in A positions are disposed so that the axial direction of each of these pivot shafts is oriented perpendicular to the direction of the radial line that extends from the center of disposition O of three outer cutters 22. The pivot shafts in B positions are disposed so that the axial direction of each of these pivot shafts is on the radial line. As a result, each of the outer cutters 22 is supported by two pivot shafts that are mutually perpendicular, and the outer cutters thus can tilt in all directions at any desired angle. In the shown embodiment, the orientations of the pivot shafts are uniformly disposed with respect to the center of disposition of the outer cutters 22. As a result, the same feeling of use is obtained regardless of the direction from which the outer cutters 22 are used.

Figure 2A:
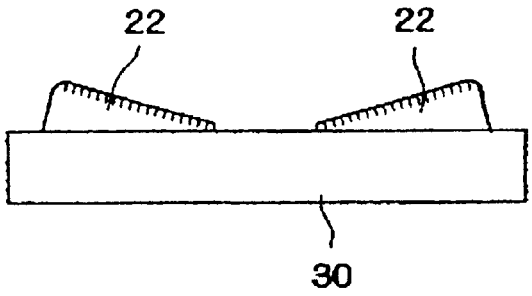
FIG. 2 is an explanatory diagram showing the outer cutters tilted relative to the cutter frame.
Figure 2B:
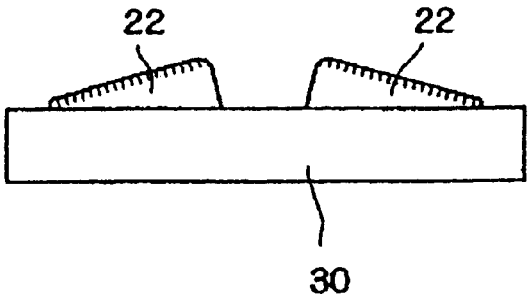

Since the outer cutters disposed in the cutter frame 30 are supported by pivot shafts that are perpendicular to each other as shown in FIG. 1, the outer cutters 22 can tilt in any desired direction. Accordingly, shaving is performed with the outer cutters 22 fitted against the skin in an ideal manner. FIG. 2 shows the outer cutters 22 tilted with respect to the cutter frame 30. Since each of the outer cutters 22 can independently tilt, the respective outer cutters 22 tilt as desired and fit the skin in accordance with the shaving position. Since the outer cutters 22 are supported by pivot shafts, restrictions in tilting of the outer cutters 22 that are caused by the protruding edges 21 contacting the cutter frame 30 as in the conventional electric shavers can be avoided. Furthermore, since the outer cutters 22 are supported by pivot shafts, when one side of the outer cutter 22 rises, the other side of the outer cutter 22 drops; and a large tilting angle can easily be obtained.

Figure 3:
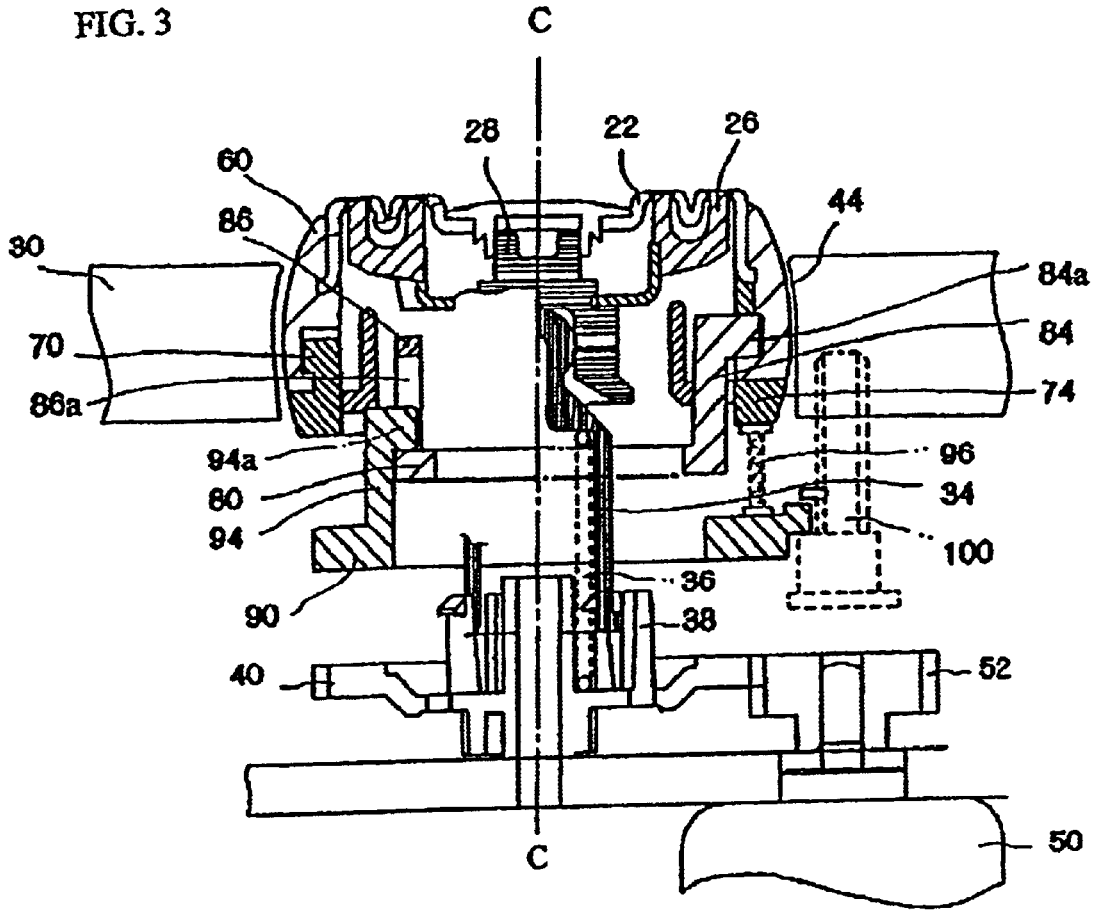
FIG. 3 is a sectional view of the support of the outer cutters on the cutter retaining plate via fulcrum plates.

FIG. 3 shows a concrete structure of one of the outer cutters 22 supported by pivot shafts. In the electric rotary shaver of this embodiment, each outer cutter 22 is disposed in an outer cutter casing 60 that is made of resin and has an outer circumferential surface formed in a spherical surface shape that protrudes outward, so that the outer cutter and the outer cutter casing make a single body. Furthermore, the inside wall surface of each of the outer cutter holes 44 of the cutter frame 30 that accommodates the outer cutter 22 is formed as a sliding contact surface with which the outer circumferential surface of the outer cutter casing 60 makes a sliding contact. The outer cutter 22 is thus tiltable in any desired direction.

In FIG. 3, the reference numeral 70 is an outer cutter fastening ring that anchors the outer cutter casing 60, 80 is a fulcrum plate that supports the outer cutter fastening ring 70 by first pivot shafts 84*a*, and 90 is a cutter retaining plate that supports the fulcrum plate 80 by second pivot shafts 94*a*. The cutter retaining plate 90 is fastened to the underside of the cutter frame 30 by a screw 100 and thus supports the fulcrum plate 80. In this embodiment, the outer cutter casing 60 and the outer cutter fastening ring 70 constitute a supporting member that supports the outer cutter 22.

The structure that rotates the inner cutters 26 by motor 50 is the same as that of a conventional electric shaver. Inner cutter drive gears 40 (only one drive gear is shown) engage with a gear 52 that is coupled to the output shaft of the motor 50, and engaging projections 38 of the drive gears 40 engage with the inner cutter drive shafts 34, so that the driving force of the motor 50 is transmitted to the inner cutters 26 as a rotational driving force. The inner cutters 26 are urged in a direction that presses the inner cutters 26 against the inner surfaces of the outer cutters 22 by springs 36 which perform an elastic spring action between the inner cutter drive shafts 34 and the inner cutter drive gears 40.

Figure 4:
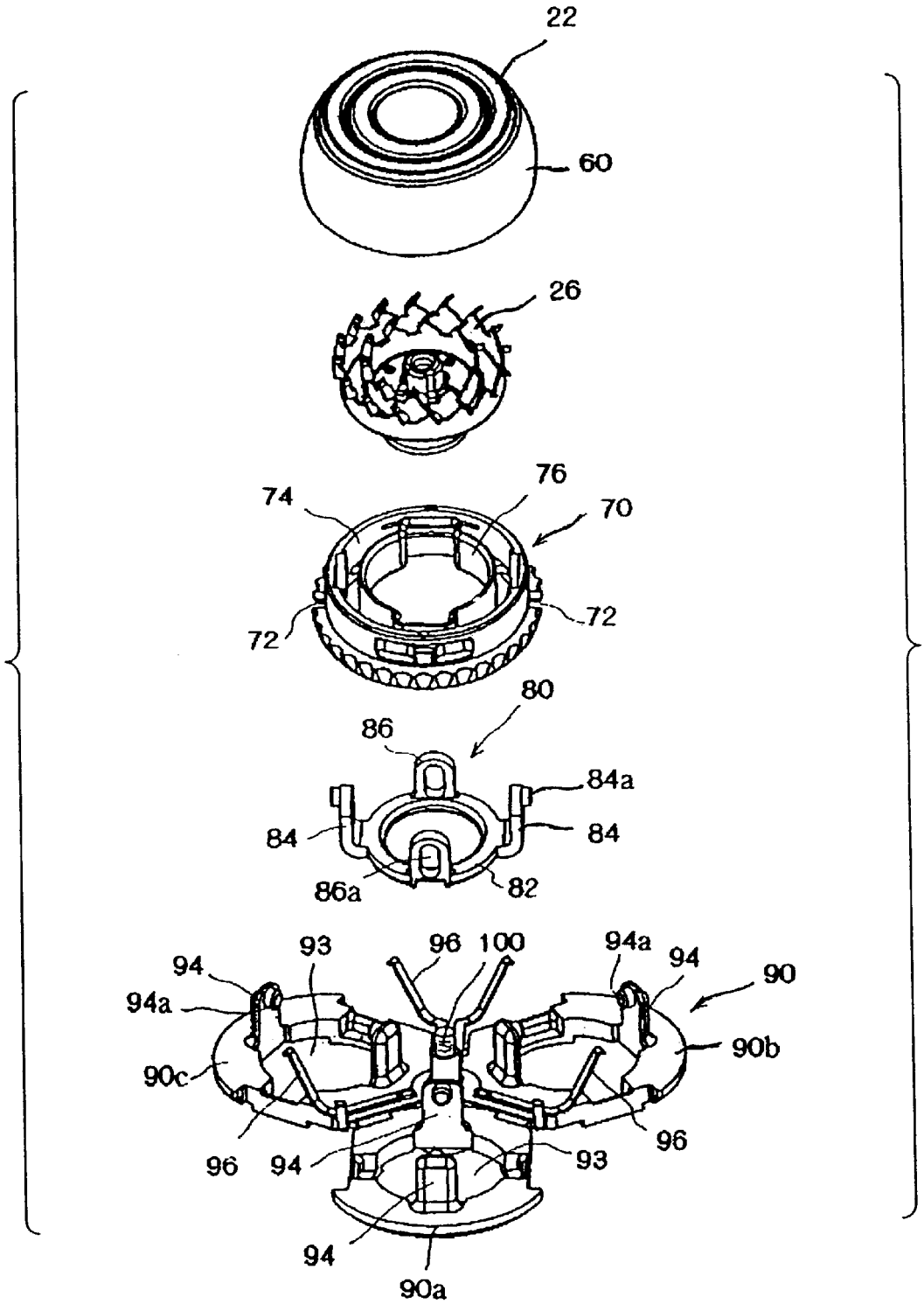
FIG. 4 is a perspective view of the assembly in which the fulcrum plates, outer cutter fastening rings and outer cutter casings are disposed in the cutter retaining plate.

As described above, the outer cutters 22 disposed in the outer cutter casings 60 are tiltably supported by the mutual engagement of the cutter retaining plate 90, fulcrum plates 80 and outer cutter fastening rings 70. FIG. 4 is a perspective view that shows the assembly of these components.

FIG. 4 illustrates an assembly process in which the fulcrum plates 80 are disposed on the cutter retaining plate 90, the outer cutter fastening rings 70 are provided in the fulcrum plates 80, and the outer cutter casings 60 are provided on the outer cutter fastening rings 70. FIG. 4 shows the manner in which the respective fulcrum plate 80, outer cutter fastening ring 70 and outer cutter casing 60 is disposed in one of three cutter retaining sections 90*a* of the cutter retaining plate 90. In other words, the other fulcrum plate 80, outer cutter fastening rings 70 and outer cutter casing 60 are disposed respectively in each of three cutter retaining sections 90*a*, 90*b* and 90*c* in the same manner. Each of the inner cutters 26 is set in the outer cutter casing 60 that is provided between the outer cutter fastening ring 70 and the outer cutter 22.

Figure 5A:
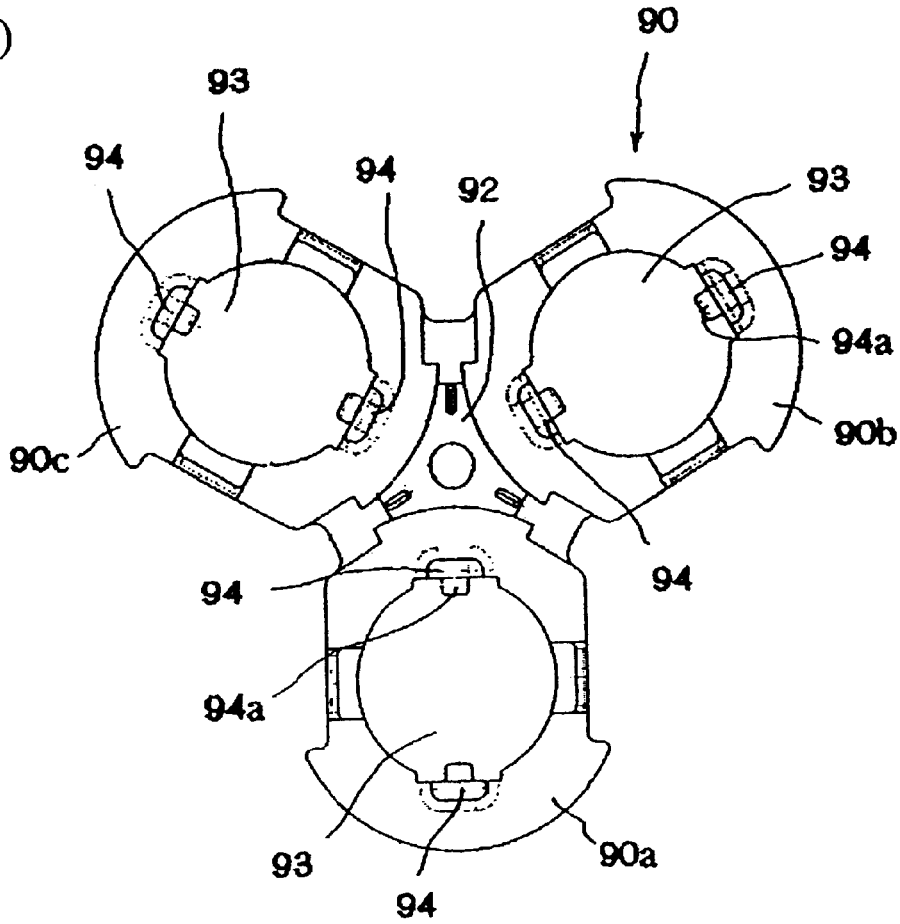
FIG. 5 is a top view and side view of the cutter retaining plate.
Figure 5B:
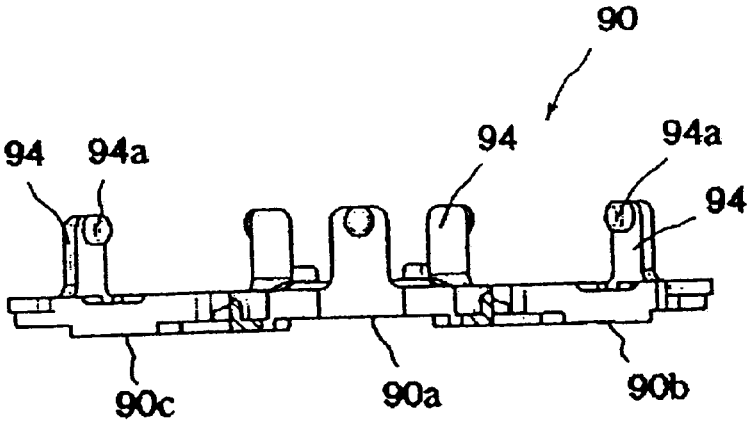

FIGS. 5(*a*) and 5(*b*) are a top view and a side view of the cutter retaining plate 90. As seen from FIG. 5(*a*), the cutter retaining sections 90*a*, 90*b* and 90*c* are formed in the cutter retaining plate 90 in a form of three branches that are separated by angles of 120°. The cutter retaining sections 90*a*, 90*b* and 90*c* positionally correspond to the three outer cutters 22 which are disposed at vertices of an equilateral triangle. The base portions of the cutter retaining sections 90*a*, 90*b* and 90*c* are connected to each other by a connecting plate 92, and circular through-holes 93 are formed inside the respective cutter retaining sections 90*a*, 90*b* and 90*c*.

Second supporting pillars 94 are formed in an upright configuration on the inside edges of the through-holes 93 of the cutter retaining sections 90*a*, 90*b* and 90*c*. FIG. 5(*b*) shows the upright configuration of the second supporting pillars 94 formed on the cutter retaining sections 90*a*, 90*b* and 90*c*. The second supporting pillars 94 are for pivot-supporting the fulcrum plates 80; and projection-form second pivot shafts 94*a* are formed on the respective second supporting pillars 94 so as to protrude from the opposite inside wall surfaces of the respective second supporting pillars 94. In the shown embodiment, as seen from FIG. 5(*a*), the second supporting pillars 94 are disposed in a pair for the respective cutter retaining sections 90*a*, 90*b* and 90*c* so that the second supporting pillars 94 are positioned on imaginary straight lines that connect the center of the connecting plate 92 and the centers of the through-holes 93.

The connecting plate 92 is formed with an attachment hole at the center so that the screw 100 is attached thereto. FIG. 4 shows the screw 100 screwed to the attachment hole.

A plate spring 96 is disposed in the connecting plate 92 of the cutter retaining plate 90 via the screw 100. The plate spring 96 urges the outer cutters 22 upward by contacting the undersides of the outer cutter fastening rings 70. The plate spring 96 also supports the three outer cutter fastening rings 70 so that all outer cutter fastening rings 70 are tilted outward. The plate spring 96 is disposed so that each two plate springs branch out to cross above the connecting plate 92 in three directions from the position where the plate springs 96 are attached by the screw 100; and from the positions where the branched plate springs 96 cross the connecting plate 92, the branched plate springs 96 extend upward at an inclination along the sides of the respective cutter retaining sections 90*a*, 90*b* and 90*c*. The reference numerals 96*a* refer to extended ends of the branched plate springs 96. The tip ends of the extended ends 96*a* are slightly bent so as to be substantially parallel to the cutter retaining plate 90.

Figure 6A:
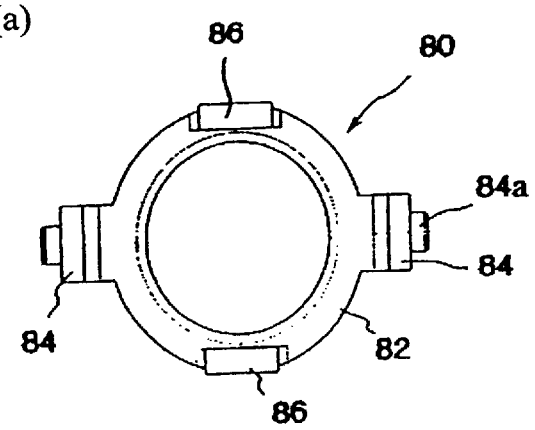
FIG. 6 is a top view and side views of one of the fulcrum plates.
Figure 6B:
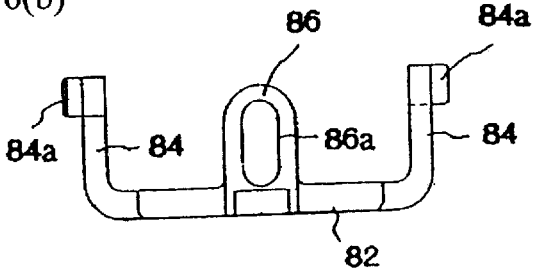
Figure 6C:
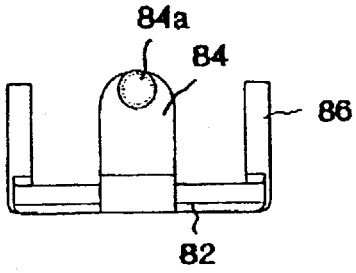

FIGS. 6(*a*) and 6(*b*) are a plan view and a side view of one of the fulcrum plates 80 that are disposed in the cutter retaining plate 90. Each fulcrum plate 80 has respective pairs of first supporting pillars 84 and engagement pillars 86 that are formed upright on a ring portion 82 that are in a circular ring shape. A pair of the first supporting pillars 84 and a pair of the engagement pillars 86 are arranged at right angles relative to each other. The engagement pillars 86 engage with the second supporting pillars 94 of the cutter retaining plate 90.

As seen from FIG. 6(*b*), engaging holes 86*a* are formed in the engagement pillars 86. The engaging holes 86*a* are slots that extend in the vertical direction. The engaging holes 86*a* are formed with dimensions that allow the second pivot shafts 94*a* disposed on the second supporting pillars 94 to be inserted therein. By way of engaging the second pivot shafts 94*a* of the second supporting pillars 94 with the engaging holes 86*a* of the fulcrum plates 80, the fulcrum plates 80 are supported in the cutter retaining plate 90.

The external diameter of the ring portions 82 of the fulcrum plates 80 is slightly smaller than the internal diameter of the through-holes 93 formed in the cutter retaining sections 90*a*, 90*b* and 90*c*. As a result, the outer surfaces of the engagement pillars 86 of the fulcrum plates 80 make a sliding contact with the inner surfaces of the second supporting pillars 94. Thus, the fulcrum plates 80 are engaged with the second pivot shafts 94*a* and tilt. Also, the fulcrum plates 80 are movable vertically within the movement range defined by the slot-form engaging holes 86*a*. The reason that the fulcrum plates 80 are provided so as to be movable in the vertical direction is to ensure that the outer cutters 22 (together with the inner cutters 26) can sink inward during shaving.

The outer cutters 22 are constantly urged upward by the driving force of the springs 36 mounted on the inner cutter drive shafts 34 and by the driving force of the plate springs 96. Accordingly, the fulcrum plates 80 are also urged upward via the outer cutter fastening rings 70, and the fulcrum plates 80 are positioned so that the second pivot shafts 94*a* contact the lowermost portions of the engaging holes 86*a*. More specifically, the fulcrum plates 80 are constantly maintained in upper positions in which the second pivot shafts 94*a* contact the lowermost ends of the engaging holes 86*a*, so that the fulcrum plates 80 can tilt about the pivot shafts 94*a*. The fulcrum plates 80 are supported in the most stable fashion when the second pivot shafts 94*a* contact the lowermost ends of the engaging holes 86*a*; however, even when the second pivot shafts 94*a* are positioned in intermediate positions in the engaging holes 86*a*, a sufficient supporting effect thereof is obtained. In the shown embodiment, the second pivot shafts 94*a* contact the lowermost ends of the engaging holes 86*a* by way of the biasing force of the springs 36 and plate springs 96. However, the plate springs 96 can be omitted, so that only the springs 36 are used.

The first supporting pillars 84 formed on the ring portions 82 of the fulcrum plates 80 are used to support the outer cutter fastening rings 70 so that the outer cutter fastening rings 70 can tilt. As shown in FIG. 6(*b*), the first supporting pillars 84 are formed upright on the ring portions 82 of the fulcrum plates 80, and projection-form first pivot shafts 84*a* are formed on the outer surfaces of the upper portions of the first supporting pillars 84. These first pivot shafts 84*a* engage with engaging recesses 72 formed on the outer surfaces of the outer cutter fastening rings 70, thus supporting the outer cutter fastening rings 70 so that the outer cutter fastening rings 70 can tilt.

Figure 7A:
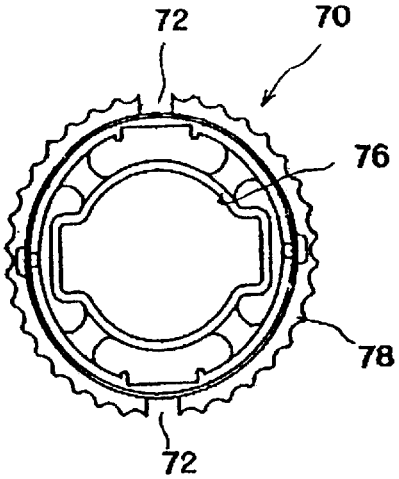
FIG. 7 is a top view and side view of one of the outer cutter fastening rings.
Figure 7B:
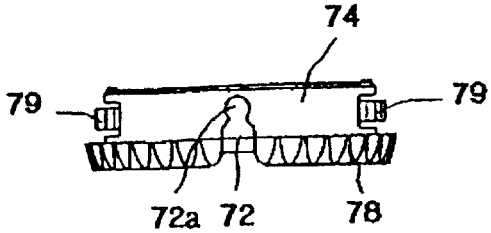

FIGS. 7(*a*) and 7(*b*) are a top view and a side view of one of the outer cutter fastening rings 70. Each of to outer cutter fastening rings 70 is comprised of a cylindrical portion 74 that is formed in a short tubular shape, an inner cutter supporting portion 76 that is formed on the inside of the cylindrical portion 74, and a flange portion 78 that is formed along the lower edge of the cylindrical portion 74. As seen from FIG. 7(*b*), the engaging recesses 72 are formed in the outer surfaces of the flange portion 78 and cylindrical portion 74. The upper end portions of the engaging recesses 72 are formed as circular grooves 72*a* so that the first pivot shafts 84*a* fit therein and pivot. The lower portions of the engaging recesses 72 are opened more widely than the circular grooves 72*a*. As a result, the first pivot shafts 84*a* of the fulcrum plates 80 are inserted into to engaging recesses 72 from below, and the outer cutter fastening rings 70 are supported in the fulcrum plates 80 by click engagement with the round grooves 72*a*.

When the first pivot shafts 84*a* of the fulcrum plates 80 are engaged with the outer cutter fastening rings 70, the outer cutter fastening rings 70 are shaft-supported so that they can tilt about the first pivot shafts 84*a*. In FIG. 7(*b*), the reference numerals 79 are stoppers that act when the outer cutter casings 60 are fitted in the outer cutter fastening rings 70. When the outer cutter casings 60 are set over the outer cutter fastening rings 70 and pressed, the outer cutter casings 60 are disposed in the outer cutter fastening rings 70.

FIG. 3 shows as described above a state in which the fulcrum plates 80 are installed in the cutter retaining plate 90, the outer cutter fastening rings 70 are disposed in the fulcrum plates 80, and the outer cutter casings 60 are disposed in the outer cutter fastening rings 70. FIG. 3 involves two sectional views in which the viewing directions of the sections differ by 90° on the left and right sides with reference to line C—C.

Here, it is shown in FIG. 3, as described above, that the cutter retaining plate 90 is fastened to the cutter frame 30 by the screw 100, that the fulcrum plates 80 and cutter retaining plate 90 are supported by engaging the second pivot shafts 94*a* of the cutter retaining plate 90 with the engaging holes 86*a* of the engagement pillars 86 of the fulcrum plates 80, and that the fulcrum plates 80 and outer cutter fastening rings 70 are supported by engaging the first pivot shafts 84*a* of the fulcrum plates 80 with the engaging recesses 72 of the outer cutter fastening rings 70.

The tip ends of the plate springs 96 are in contact with the bottoms of the outer cutter fastening rings 70 and perform an elastic spring action between the cutter retaining plate 90 and the outer cutter fastening rings 70. Since the outer cutter fastening rings 70 are supported so that they can tilt by the first pivot shafts 84*a*, the inclination of the outer cutters 22 in the initial state during use can be set by appropriately setting the positions where the plate springs 96 contact the undersides of the outer cutter fastening rings 70 in terms of the relative positional relationship with the first pivot shafts 84*a*. More specifically, if the positions where the plate springs 96 contact the outer cutter fastening rings 70 are set further toward the center than the imaginary lines that connects the paired first pivot shafts 84*a* (i.e., in positions shifted toward the center of the equilateral triangular configuration in which the three outer cutters are disposed), then the initial postures of the outer cutters 22 are such a tilted state that the center sides of the equilateral triangular configuration of the outer cutters are high and the outer sides of the cutters are low. Conversely, if the positions where the plate springs 96 contact the outer cutter fastening rings 70 are set further to the outside than the imaginary lines that connects the paired first pivot shafts 84*a*, then a state in which the outer cutters 22 are tilted so that the center sides are low and the outer sides are high will be the initial postures of the outer cutters 22.

FIG. 2 shows the tilted outer cutters 22. Setting the outer cutters 22 in a tilted position before using the shaver is advantageous since this makes it easier to fit the outer cutters 22 against the skin during shaving. For example, if the outer cutters 22 are tilted as shown in FIG. 2(*b*) so that the outer sides of the cutters are set to be lower at the beginning of the use of the shaver, then all three outer cutters 22 snugly contact the skin when shaving is initiated, and all the outer cutters 22 can be more easily fitted against the skin.

The most important feature in the structure of the electric rotary shaver of the shown embodiment is that the three outer cutters 22 provided in the cutter frame 30 are supported via first pivot shafts 84*a* and second pivot shafts 94*a* that are disposed perpendicular to each other, so that the outer cutters 22 can tilt in any desired direction. More specifically, the fulcrum plates 80 are supported so that they are tiltable by the second pivot shafts 94*a* of the cutter retaining plate 90, and the outer cutter fastening rings 70 are supported so that they are tiltable by the first pivot shafts 84*a* of the fulcrum plates 80. Thus, the outer cutters 22 are pivot-supported by two axes that are perpendicular to each other, so that the outer cutters 22 can tilt in any desired direction.

Figure 8:
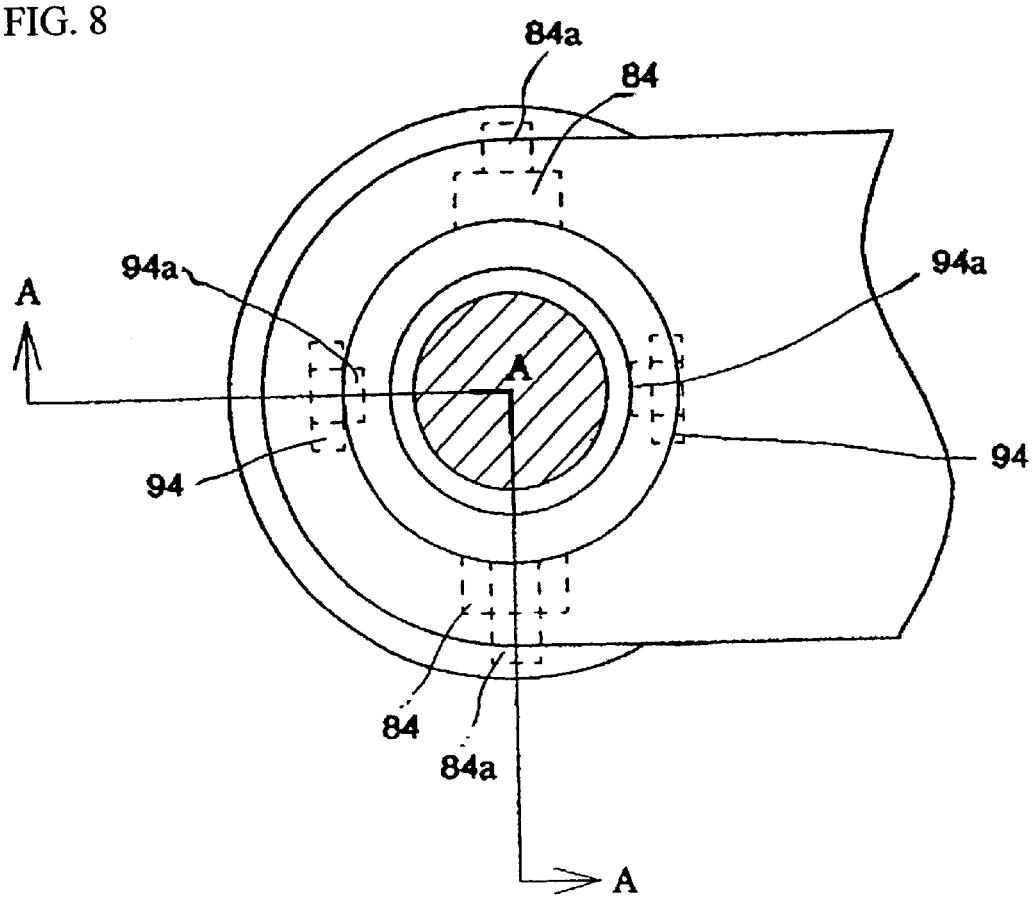
FIG. 8 is an explanatory diagram that shows a layout of the pivot shafts.
Figure 9:
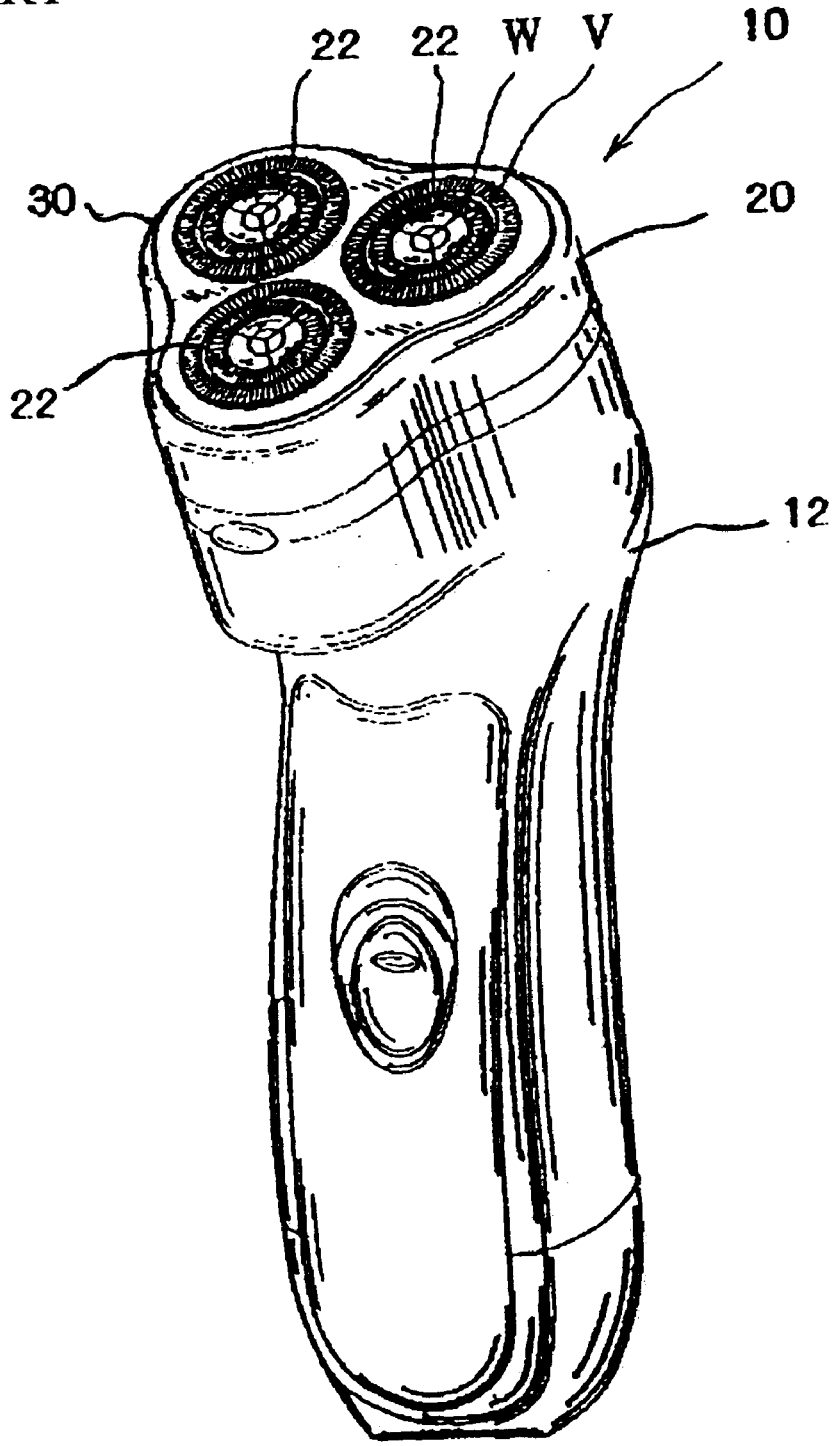
FIG. 9 PRIOR ART
FIG. 9 is an external view of a conventional electric rotary shaver.
Figure 10:
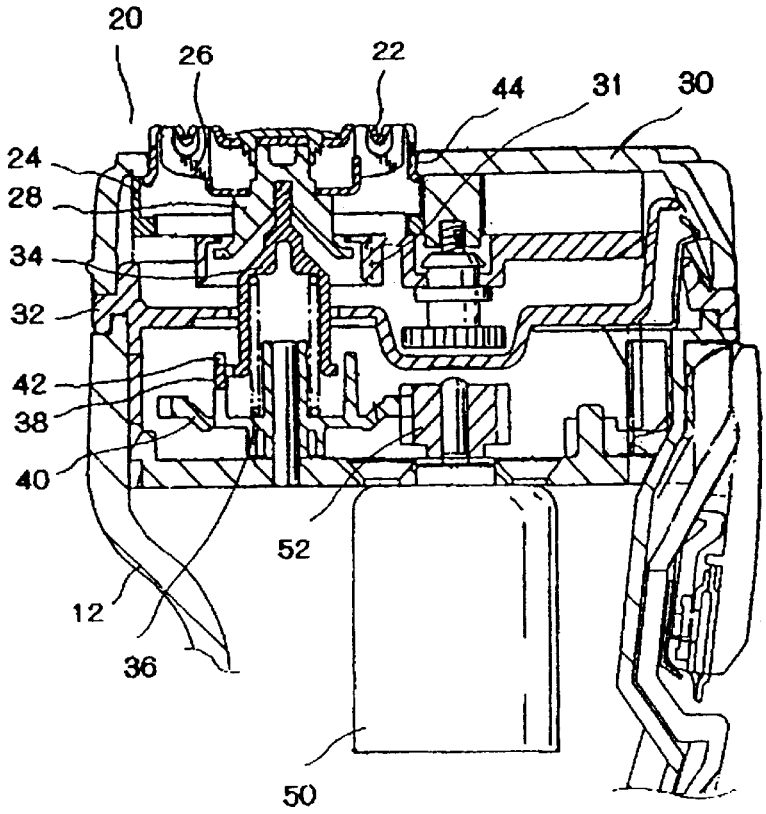
FIG. 10 PRIOR ART
FIG. 10 is a sectional view of the internal structure of a conventional electric rotary shaver.
Figure 11A:
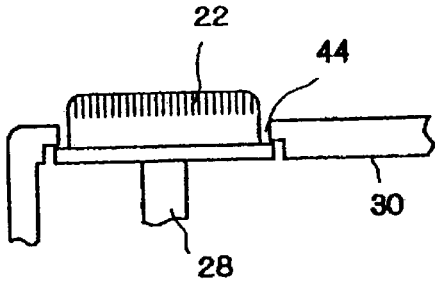
FIG. 11(a) PRIOR ART
FIG. 11 is an explanatory diagram showing the tilting of the outer cutters in a conventional electric rotary shaver.
Figure 11B:
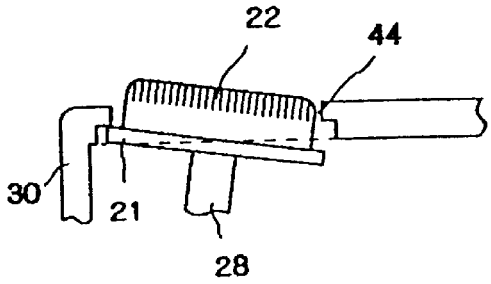
FIG. 11(b) PRIOR ART

FIG. 8 shows the layout of the first pivot shafts 84*a* and second pivot shafts 94*a*. As seen from FIG. 8, the axes of the first pivot shafts 84*a* and second pivot shafts 94*a* are perpendicular to each other in a plan layout; however, as shown in FIG. 3, the positions of the axes are slightly different in the vertical direction. The reason for this difference is that in the shown embodiment the second pivot shafts 94*a* are fitted in the slot-form engaging holes 86*a* in order to allow the outer cutters 22 to sink inward (together with the inner cutters 26). In the structure of this embodiment as well, the tilting of the outer cutters 22 does not cause any practical problems, and the shown embodiment is advantageous in that the structure allows the outer cutters 22 to sink inward. As a result of these pivot supports, the rotation of the outer cutters 22 is prevented at the same time.

The second pivot shafts 94*a* are not necessarily needed to move up and down. The second pivot shafts 94*a* can be shaft-supported so as not to be moved up and down in the engagement pillars 86 of the fulcrum plates 80. In this structure, the first pivot shafts 84*a* and second pivot shafts 94*a* may be set at the same height, so that uniform tilting of the fulcrum plates 80 in all directions is possible. Furthermore, in order to allow the outer cutters 22 to sink inward, it is advisable to install the cutter retaining plate 90 so as to constantly drive the outer cutters 22 in a direction that causes the outer cutters to protrude outward and so that the cutter retaining plate 90 is moved up and down relative to the cutter frame 30. The cutter retaining plate 90 can be supported in a floating manner by attaching the cutter retaining plate 90 by the screw 100 to the cutter frame 30 with a spring in between.

In the above-described embodiments, three outer cutters 22 are disposed at the vertices of an equilateral triangle. However, a structure in which the respective outer cutters are supported by means of two pairs of pivot shafts that are perpendicular to each other is advantageous in any electric rotary shaver that include two or more outer cutters in a cutter frame 30. In an electric shaver that involves a plurality of outer cutters, the structure that allows the outer cutters to tilt in all directions is advantageous since the outer cutters can snugly fit against the skin and improve the feeling of use during shaving.

According to the electric rotary shaver of the present invention, as described above, the outer cutters are supported via pivot shafts which are disposed perpendicular to each other, so that the outer cutters tilt as desired in all directions. Thus, the present invention provides an electric shaver in which the outer cutters can easily fit against the skin, and a good cutting effect is obtained.

What is claimed is:

1. An electric rotary shaver comprising: a cutter frame provided with a plurality of outer cutter holes, outer cutters integrally provided with outer cutter casings, said outer cutter casings disposed in respective said outer cutter holes so as to be tiltable in any direction, and inner cutters rotatably disposed inside said outer cutters, said inner cutters being connected to inner cutter drive shafts which are rotationally driven and urged in a direction that causes said inner cutter drive shafts to protrude outward, wherein said rotary shaver further comprising:

a cutter retaining plate provided inside and coupled to said cutter frame so as to be on a main body side of said electric shaver, and fulcrum plates respectively tiltably supported by said cutter retaining plate, said fulcrum plates being disposed so as to positionally correspond respectively to said outer cutter holes, and wherein said outer cutter casings are tiltably supported by said respective fulcrum plates by supporting members in a direction that is perpendicular to a direction in which said fulcrum plates are tiltably supported by said cutter retaining plate, so that said outer cutter casings together with said integral outer cutters are axially tiltable in any direction and tilting of said outer cutter casings together with said outer cutters is not limited by said cutter frame.

2. The electric rotary shaver according to claim 1, wherein supporting directions in which respective said fulcrum plates are shaft-supported are set so as to be on radial lines that passes through a center of said cutter frame, and supporting directions in which said outer cutters are shaft-supported are set so as to be in directions that are perpendicular to said radial lines.

3. The electric rotary shaver according to claim 1, wherein said outer cutters are metallic and said outer cutter casings are resin molded integrally on said outer cutters, outer surfaces of said outer cutter casings making a sliding contact with said inner surfaces of said outer cutter holes.

4. The electric rotary shaver according to claim 3, wherein longitudinal outer surfaces of said outer cutters casing are formed in a spherical surface shape that protrudes outward.

5. An electric rotary shaver comprising: a cutter frame provided with a plurality of outer cutter holes, outer cutters disposed in respective said outer cutter holes so as to be tiltable in any direction, and inner cutters rotatably disposed inside said outer cutters, said inner cutters being connected to inner cutter drive shafts which are rotationally driven and urged in a direction that causes said inner cutter drive shafts to protrude outward, wherein said rotary shaver further comprising:

a cutter retaining plate provided inside said cutter frame so as to be on a main body side of said electric shaver, and fulcrum plates respectively shaft-supported in said cutter retaining plate in a tiltable fashion, said fulcrum plates being disposed so as to positionally correspond respectively to said outer cutter holes, and wherein said outer cutters are shaft-supported in said respective fulcrum plates by supporting members in a direction that is perpendicular to a direction in which said fulcrum plates are shaft-supported by said cutter retaining plate, so that said outer cutters are axially tiltable in any direction; and outer cutter fastening rings are shaft-supported in said fulcrum plates, and said outer cutters are tiltably supported in said fulcrum plates via said outer cutter fastening rings.

6. The electric rotary shaver according to claim 5, wherein said outer cutters are disposed in outer cutter casings that are tiltable inside said outer cutter holes, and said outer cutter casings are supported in said outer cutter fastening rings.

7. An electric rotary shaver comprising: a cutter frame provided with a plurality of outer cutter holes, outer cutters disposed in respective said outer cutter holes so as to be tiltable in any direction, and inner cutters rotatably disposed inside said outer cutters, said inner cutters being connected to inner cutter drive shafts which are rotationally driven and urged in a direction that causes said inner cuter drive shafts to protrude outward, wherein said rotary shaver further comprising:

a cutter retaining plate provided inside said cutter frame so as to be on a main body side of said electric shaver, and fulcrum plates respectively shaft-supported in said cutter retaining plate in a tiltable fashion, said fulcrum plates being disposed so as to positionally correspond respectively to said outer cutter holes, and wherein said outer cutters are shaft-supported in said respective fulcrum plates by supporting members in a direction that is perpendicular to a direction in which said fulcrum plates are shaft-supported by said cutter retaining plate, so that said outer cutters are axially tiltable in any direction; and said cutter retaining plate is constantly urged with respect to said cutter frame in a direction that causes said outer cutters to protrude outward, and said cutter retaining plate is installed so as to be moved up and down.

8. An electric rotary shaver comprising: a cutter frame provided with a plurality of outer cutter holes, outer cutters disposed in respective said outer cutter holes so as to be tiltable in any direction, and inner cutters rotatably disposed inside said outer cutters, said inner cutters being connected to inner cutter drive shafts which are rotationally driven and urged in a direction that causes said inner cutter drive shafts to protrude outward, wherein said rotary shaver further comprising:

a cutter retaining plate provided inside said cutter frame so as to be on a main body side of said electric shaver, and fulcrum plates respectively shaft-supported in said cutter retaining plate in a tiltable fashion, said fulcrum plates being disposed so as to positionally correspond respectively to said outer cutter holes, and wherein said outer cutters are shaft-supported in said respective fulcrum plates by supporting members in a direction that is perpendicular to a direction in which said fulcrum plates are shaft-supported by said cutter retaining plate, so that said outer cutters are axially tiltable in any direction; and pairs of supporting pillars that have pivot shafts are formed on said cutter retaining plate at positions that correspond to respective said outer cutter holes, and pairs of engagement pillars that have slot-form engaging holes are formed on said fulcrum plates; and wherein said pivot shafts are engaged with said engaging holes, thus allowing said outer cutters to be moved up and down.

* * * * *